US008164533B1

(12) United States Patent
Hsu et al.

(10) Patent No.: US 8,164,533 B1
(45) Date of Patent: Apr. 24, 2012

(54) HORN ANTENNA AND SYSTEM FOR TRANSMITTING AND/OR RECEIVING RADIO FREQUENCY SIGNALS IN MULTIPLE FREQUENCY BANDS

(75) Inventors: Chih-Chien Hsu, Cherry Hill, NJ (US); Sudhakar K. Rao, Churchville, PA (US)

(73) Assignee: Lockhead Martin Corporation, Bethesda, MD (US)

( * ) Notice: Subject to any disclaimer, the term of this patent is extended or adjusted under 35 U.S.C. 154(b) by 987 days.

(21) Appl. No.: 12/137,416

(22) Filed: Jun. 11, 2008

Related U.S. Application Data

(63) Continuation-in-part of application No. 11/594,157, filed on Nov. 8, 2006, now Pat. No. 7,463,207, which is a continuation-in-part of application No. 11/029,390, filed on Jan. 6, 2005, now abandoned.

(60) Provisional application No. 61/030,507, filed on Feb. 21, 2008, provisional application No. 60/622,785, filed on Oct. 29, 2004.

(51) Int. Cl.
*H01Q 13/00* (2006.01)

(52) U.S. Cl. ..... 343/786; 343/781 R

(58) Field of Classification Search ..... 343/786, 343/772, 781 R, 783
See application file for complete search history.

(56) References Cited

U.S. PATENT DOCUMENTS 3,662,393 A 5/1972 Cohn
4,040,061 A 8/1977 Roberts et al.
4,792,814 A * 12/1988 Ebisui ..... 343/786
5,117,240 A 5/1992 Anderson et al.
5,166,698 A 11/1992 Ashbaugh et al.
5,406,298 A * 4/1995 Walters ..... 343/776
5,974,323 A 10/1999 Doner
6,075,484 A 6/2000 Daniel et al.
6,075,495 A * 6/2000 Podgorski ..... 343/786
6,084,552 A 7/2000 Robertson et al.
6,108,561 A 8/2000 Mallinckrodt et al.
6,240,072 B1 5/2001 Lo et al.
6,329,957 B1 12/2001 Shea et al.
6,336,030 B2 1/2002 Houston et al.
6,366,256 B1 4/2002 Ramanujam et al.
6,377,561 B1 4/2002 Black et al.
6,384,795 B1 5/2002 Bhattacharyya et al.
6,396,453 B2 * 5/2002 Amyotte et al. ..... 343/786
6,441,795 B1 8/2002 Volman
6,456,252 B1 * 9/2002 Goyette ..... 343/779
6,522,306 B1 2/2003 Parrikar et al.
6,642,900 B2 11/2003 Bhattacharyya et al.
7,183,991 B2 * 2/2007 Bhattacharyya et al. ..... 343/786
2002/0000945 A1 1/2002 Amyotte et al.
(Continued)

OTHER PUBLICATIONS

Lee et al., "Design of the Optimal Feed System for High Power Microwave Antenna System," Proceeding of the Antennas and Propagation Society International Symposium, Jul. 2006, pp. 3428-3431, IEEE (Abstract).

(Continued)

*Primary Examiner* — Hoang V Nguyen
(74) *Attorney, Agent, or Firm* — McDermott Will & Emery, LLP

(57) ABSTRACT

A horn antenna includes smooth-walls with multiple slope discontinuities. The horn antenna may have more than an octave bandwidth with a 2.25:1 bandwidth ratio to cover the frequencies of 20 GHz, 30 GHz, and 45 GHz, or all the desired bands for military or other communications.

24 Claims, 14 Drawing Sheets

100

U.S. PATENT DOCUMENTS

| | | | | |
|---|---|---|---|---|
| 2003/0034422 | A1 | 2/2003 | Higgins | |
| 2005/0245265 | A1 | 11/2005 | Nascimbene et al. | |
| 2006/0125706 | A1 * | 6/2006 | Amyotte et al. | 343/786 |
| 2007/0018900 | A1 | 1/2007 | Rao et al. | |
| 2007/0225002 | A1 | 9/2007 | Keller et al. | |

OTHER PUBLICATIONS

Sudhaker K. Rao, "Parametric Design and Analysis of Multiple-Beam Reflector Antennas for Satellite Communications," Aug. 2003, pp. 26-34, vol. 45, No. 4, IEEE Antennas and Propagation Magazine.

* cited by examiner

100

1200

HORN ANTENNA AND SYSTEM FOR TRANSMITTING AND/OR RECEIVING RADIO FREQUENCY SIGNALS IN MULTIPLE FREQUENCY BANDS

CROSS REFERENCES TO RELATED APPLICATIONS

This application claims the benefit of priority under 35 U.S.C. §119 from U.S. Provisional Patent Application Ser. No. 61/030,507 entitled "ANTENNA SYSTEMS AND METHODS SUPPORTING MULTIPLE FREQUENCY BANDS AND MULTIPLE BEAMS," filed on Feb. 21, 2008, and is also a continuation-in-part of U.S. patent application Ser. No. 11/594,157 entitled "HIGH-EFFICIENCY HORNS FOR AN ANTENNA SYSTEM," filed on Nov. 8, 2006, which is a continuation-in-part of U.S. patent application Ser. No. 11/029,390 entitled "MULTIPLE-BEAM ANTENNA SYSTEM USING HIGH-EFFICIENCY DUAL-BAND FEED HORNS," filed on Jan. 6, 2005, which claims the benefit of priority under 35 U.S.C. §119 from U.S. Provisional Patent Application Ser. No. 60/622,785 entitled "MULTIPLE-BEAM ANTENNA USING HIGH-EFFICIENCY DUAL-BAND HORNS," filed on Oct. 29, 2004, all of which are hereby incorporated by reference in their entireties for all purposes.

STATEMENT AS TO RIGHTS TO INVENTIONS MADE UNDER FEDERALLY SPONSORED RESEARCH OR DEVELOPMENT

Not applicable.

FIELD

The present invention generally relates to antenna systems and, in particular, relates to a horn antenna and system for transmitting and/or receiving radio frequency signals in multiple frequency bands.

BACKGROUND

Dual-band antenna systems may be utilized for simultaneous transmission and reception of RF signals over two widely separated frequency bands at 20 GHz and 30 GHz. For example, an Advanced Extremely High Frequency satellite transmits at 20 GHz and receives at 45 GHz, and a Wideband Gap-filler. Satellite transmits at 20 GHz and receives at 30 GHz. However, these systems are taxed because amounts of information are continually increasing at an exponential rate. Additionally, existing single beam antennas use corrugated horns to extend the frequency of operation to approximately 45 GHz. However, for multiple beam applications, the corrugated horn is simply not suitable for satellite applications due to the thick walls needed to support the corrugations and thereby causing significantly lower RF performance and increased mass. Therefore, a smooth-wall horn that could operate simultaneously at the three frequency bands of 20 GHz, 30 GHz, and 45 GHz is highly desirable for satellites requiring multiple beams, including military satellites.

SUMMARY

In accordance with an exemplary embodiment of the present invention, a horn antenna is provided. In certain exemplary embodiments, the horn antenna includes smooth-walls with multiple slope discontinuities. The horn antennas may have more than an octave bandwidth with a 2.25:1 bandwidth ratio to cover 20 GHz, 30 GHz, and 45 GHz, or all the desired bands for military communications.

In accordance with one embodiment of the present invention, a horn antenna is provided for transmitting and/or receiving radio frequency signals in multiple frequency bands. The horn antenna comprises an exterior surface and an interior surface. The interior surface forms a hollow area in the horn antenna. The hollow area is substantially funnel-shaped and comprises first and second ends. The hollow area decreases in diameter from the first end to the second end. The interior surface is smooth-walled and comprises a plurality of slope discontinuities. The horn antenna also comprises an aperture disposed at the first end and comprising the largest diameter of the hollow area, and a throat disposed distally from the aperture and at the second end of the hollow area. The throat comprises the smallest diameter of the hollow area. The horn antenna is configured to transmit and/or receive radio frequency signals in multiple frequency bands that are spread over more than an octave bandwidth and with at least a 2.25-to-1 bandwidth ratio.

In accordance with an embodiment of the present invention, a horn antenna is provided for transmitting and/or receiving radio frequency signals in multiple frequency bands. The horn antenna comprises an exterior surface and an interior surface. The interior surface is disposed in the horn antenna. The interior surface forms a hollow area in the horn antenna. The hollow area is substantially funnel-shaped and comprises first and second ends. The hollow area decreases in diameter from the first end to the second end. The interior surface is smooth-walled and comprises a plurality of slope discontinuities. The horn antenna further comprises an aperture disposed at the first end and comprises the largest diameter of the hollow area. The diameter of the aperture is configured to be less than 12 times the wavelength of a highest frequency of the multiple frequency bands. The horn antenna further comprises a throat disposed distally from the aperture and at the second end of the hollow area. The throat comprises the smallest diameter of the hollow area. The horn antenna is configured to transmit and/or receive radio frequency signals in multiple frequency bands.

In accordance with one embodiment of the present invention, a horn antenna system is provided for transmitting and/or receiving radio frequencies in multiple frequency bands. The horn antenna system comprises a reflector antenna and a horn antenna. The horn antenna is configured to transmit and/or receive radio frequencies by reflecting the radio frequencies off the reflecting antenna. The horn antenna comprises an exterior surface and an interior surface disposed in the horn antenna. The interior surface forms a hollow area in the horn antenna. The hollow area is substantially funnel-shaped and comprises first and second ends. The hollow area decreases in diameter from the first end to the second end. The interior surface is smooth-walled and comprises a plurality of slope discontinuities. The horn antenna further comprises an aperture disposed at the first end that comprises the largest diameter of the hollow area, and a throat disposed distally from the aperture at the second end of the hollow area that comprises the smallest diameter of the hollow area. The horn antenna is configured to transmit and/or receive radio frequency signals in multiple frequency bands with more than an octave bandwidth and with at least a 2.25-to-1 bandwidth ratio.

In the following description, reference is made to the accompanying attachment that forms a part thereof, and in which are shown by way of illustration specific embodiments in which the invention may be practiced. It is to be understood that other embodiments may be utilized and changes may be made without departing from the scope of the present invention.

BRIEF DESCRIPTION OF DRAWINGS

The invention both to its organization and manner of operation, may be further understood by reference to the drawings that include FIGS. 1 through 14, taken in connection with the following descriptions.

DETAILED DESCRIPTION

The following description of illustrative non-limiting embodiments of the invention discloses specific configurations and components. However, the embodiments are merely examples of the present invention, and thus, the specific features described below are merely used to describe such embodiments to provide an overall understanding of the present invention. One skilled in the art readily recognizes that the present invention is not limited to the specific embodiments described below. Furthermore, certain descriptions of various configurations and components of the present invention that are known to one skilled in the art are omitted for the sake of clarity and brevity. Further, while the term "embodiment" may be used to describe certain aspects of the invention, the term "embodiment" should not be construed to mean that those aspects discussed apply merely to that embodiment, but that all aspects or some aspects of the disclosed invention may apply to all embodiments, or some embodiments.

Figure 1:
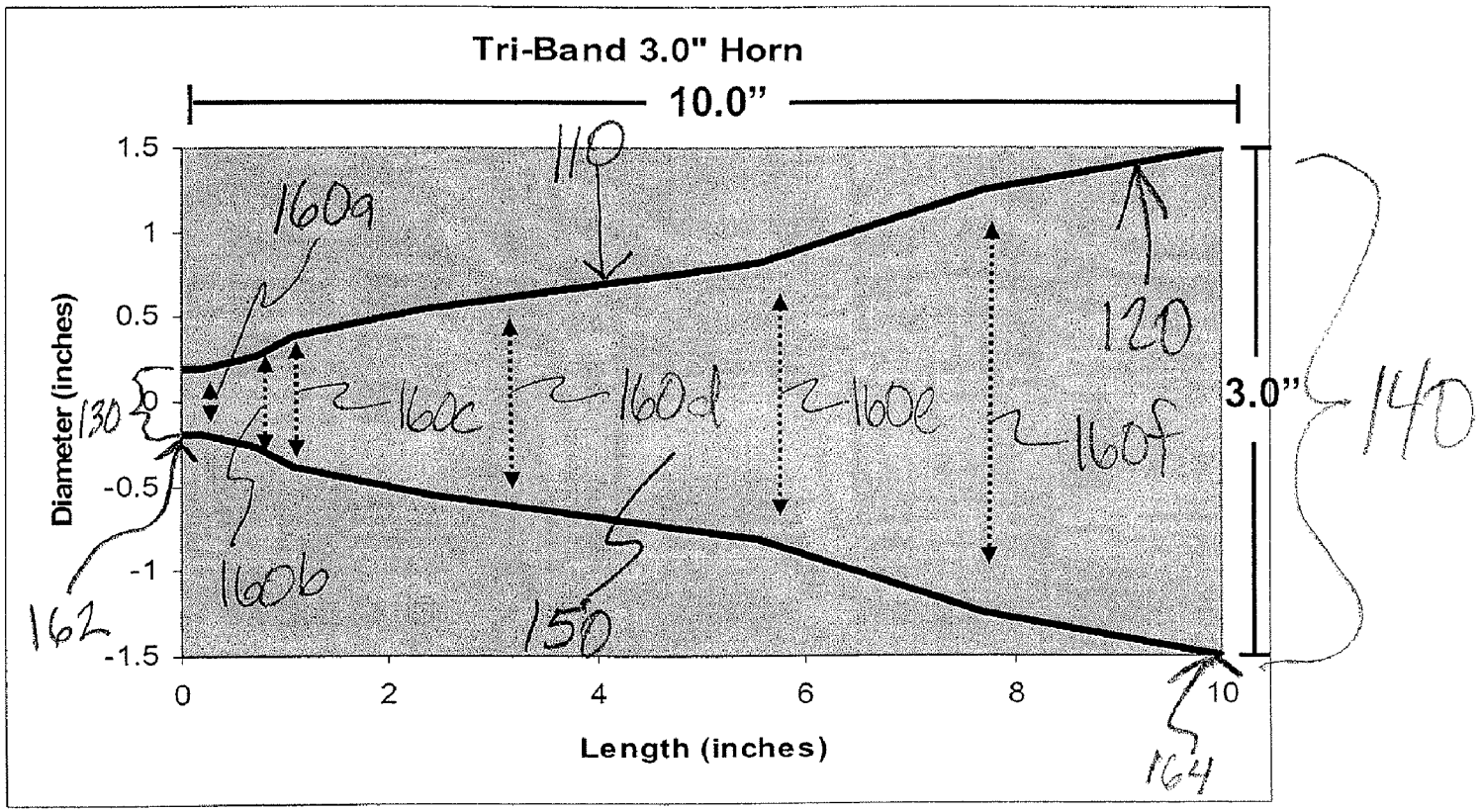
FIG. 1 is a side, cut-away view of a 3.0 inch diameter horn antenna in an exemplary embodiment of the invention.

FIG. 1 is the synthesized geometry of a 3.0 inch diameter horn of an exemplary embodiment of the present invention. The figure illustrates a side, cut-away view of horn antenna 100. The horn is circularly symmetric and the diameter of the horn as a function of the axial length is shown in the figure. Horn antenna 100 comprises an exterior surface 110, an interior surface 120, a throat 130, and an aperture 140. At least the interior surface 120 is an electrically conductive metal or metallic material (e.g., electroformed copper and/or aluminum) that allows for reception and/or transmission of radio frequency signals. Exterior surface 130 may also be metal or metallic for space applications, or may be other material (e.g., ceramic, fiberglass or plastic) for ground applications, and that provides structure for interior surface 120.

A hollow area 150 is substantially funnel-shaped, and is formed within horn antenna 100. Hollow area 150 extends from throat 130 to aperture 140 in a gradually tapered fashion along multiple slope discontinuities 160*a*, 160*b*, 160*c*, 160*d*, 160*e*, and 160*f*. In various exemplary embodiments each of the slope discontinuities 160*a*, 160*b*, 160*c*, 160*d*, 160*e*, and 160*f* may be located at varying distances from one another. In various exemplary embodiments there may be any number of slope discontinuities, to include more than three. In the exemplary embodiment shown in FIG. 1, slope discontinuity 160*a* is substantially 0.2 inches from a beginning point 162 of throat 130. Throat 130 may be connected to a feed network that could include OMTs (ortho-mode transducers), filters, waveguide bends, couplers, polarizers, transitions etc., (not illustrated) near or at beginning point 162 of the circular waveguide, as one in the skilled art would understand.

Throat 130 extends from beginning point 162 to slope discontinuity 160*a* with a diameter of substantially 0.38 inches. Slope discontinuity 160*b* is substantially 0.729 inches from beginning point 162. Hollow area 150 is substantially 0.531 inches in diameter at slope discontinuity 160*b*. Slope discontinuity 160*c* is substantially 1.073 inches from beginning point 162. Hollow area 150 is substantially 0.767 inches in diameter at slope discontinuity 160*c*. Slope discontinuity 160*d* is substantially 2.381 inches from beginning point 162. Hollow area 150 is substantially 1.086 inches in diameter at slope discontinuity 160*d*. Slope discontinuity 160*e* is substantially 5.566 inches from beginning point 162. Hollow area 150 is substantially 1.620 inches in diameter at slope discontinuity 160*e*. Slope discontinuity 160*f* is substantially 7.717 inches from beginning point 162. Hollow area 150 is substantially 2.491 inches in diameter at slope discontinuity 160*f*. The largest diameter of hollow area 150 is at end point 164 located substantially 10.023 inches from beginning point 162. At end point 164 the diameter of hollow area 150 is substantially 3.0 inches in diameter, and may be covered by a protective covering (not illustrated) known to not interfere with radio frequency transmission and reception. A protective covering might be utilized to keep debris and unwanted material from entering hollow area 150.

One of skill in the art would understand that hollow area 150 may be left as is for space applications, but may be partially or completely filled with material known to not impede radio frequency transmission and reception, such as foam or glass.

While hollow area 150 is referred to herein as possessing a "diameter," those skilled in the art would understand that horn antenna 100 may be used for either circular or linear polarizations.

When tested, the exemplary embodiment of the present invention described in relation to FIG. 1 produced the properties shown in the below table.

| Frequency (GHz) | Return Loss (dB) | Edge Taper (dB) | X-pol (20°) (dB) | Efficiency (%) |
|---|---|---|---|---|
| 20.2 | −22.4 | 18.8 | −25.9 | 79 |
| 21.2 | −26.0 | 18.9 | −23.7 | 82 |
| 30.0 | −45.0 | 29.9 | −24.2 | 60 |
| 31.0 | −45.1 | 29.9 | −28.9 | 62 |
| 43.5 | −35.9 | 32.7 | −24.8 | 63 |
| 45.5 | −37.8 | 31.8 | −24.4 | 63 |

Figure 2:
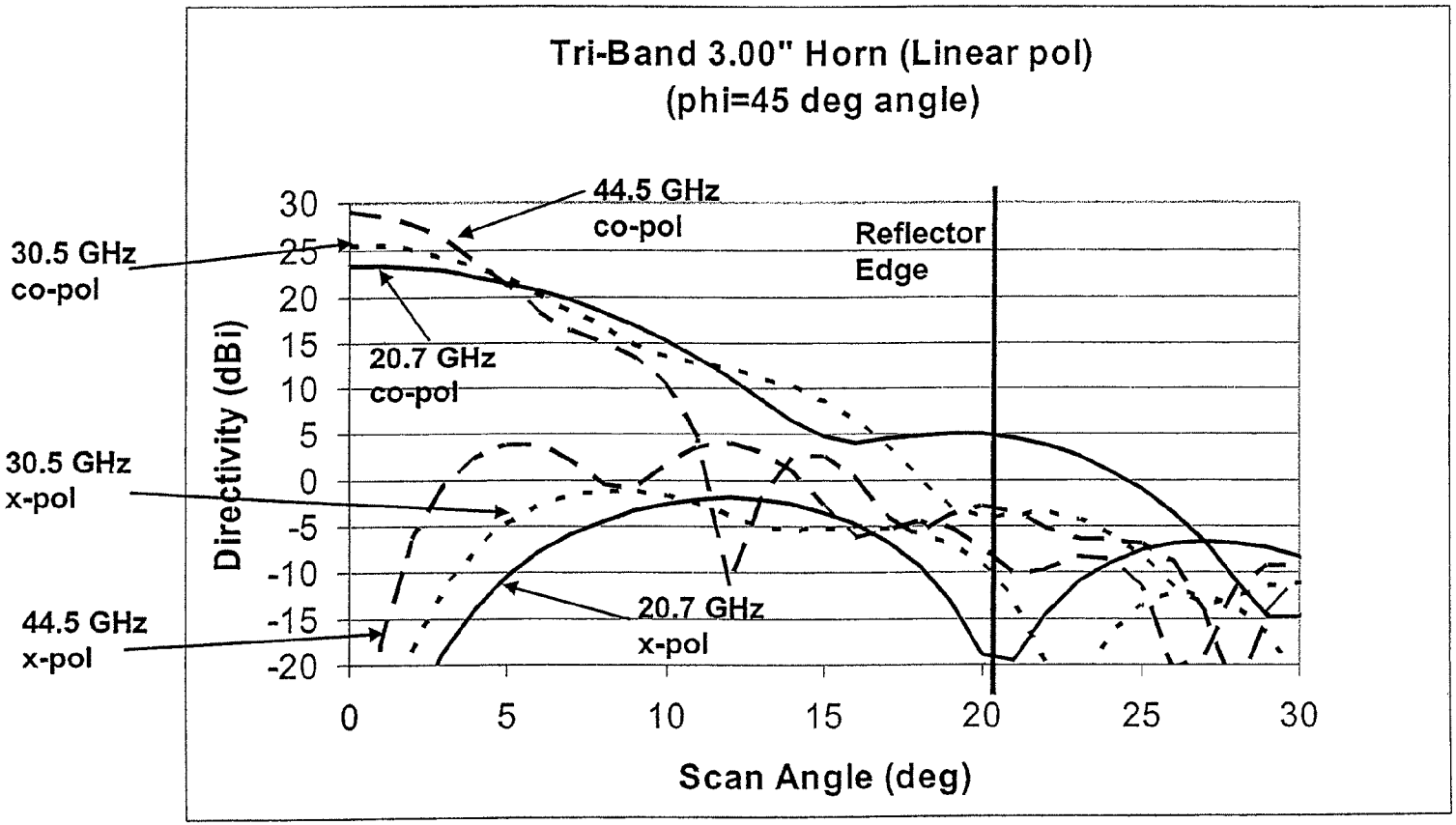
FIG. 2 is a graph of radiation patterns of the 3.0 inch horn at three frequency bands of the exemplary embodiment of the invention.

FIG. 2 shows the computed primary radiation pattern amplitudes taken in accordance with the exemplary embodiment of the present invention described in relation to FIG. 1. FIG. 2 shows levels of co- and cross-polarization for three frequency carriers, including 20.7 GHz, 30.5 GHz, and 44.5 GHz. Notably the cross-polarization levels are generally much lower than the co-polarization levels. Examples of frequency band pass for each carrier include: for 20.7 GHz, 20.2 to 21.2 GHz; for 30.5 GHz, 30.0 to 31.0 GHz, and for 44.5 GHz, 43.5 to 45.5 GHz. The noted frequency carriers may be used for military or other applications, for example, for use with an Advanced Extremely High Frequency satellite that transmits at 20 GHz and receives at 45 GHz, or a Wideband Gap-filler Satellite that transmits at 20 GHz and receives at 30 GHz, or a combination of the two satellites that transmits and receives in any or all of the three frequency carrier ranges.

Figure 3:
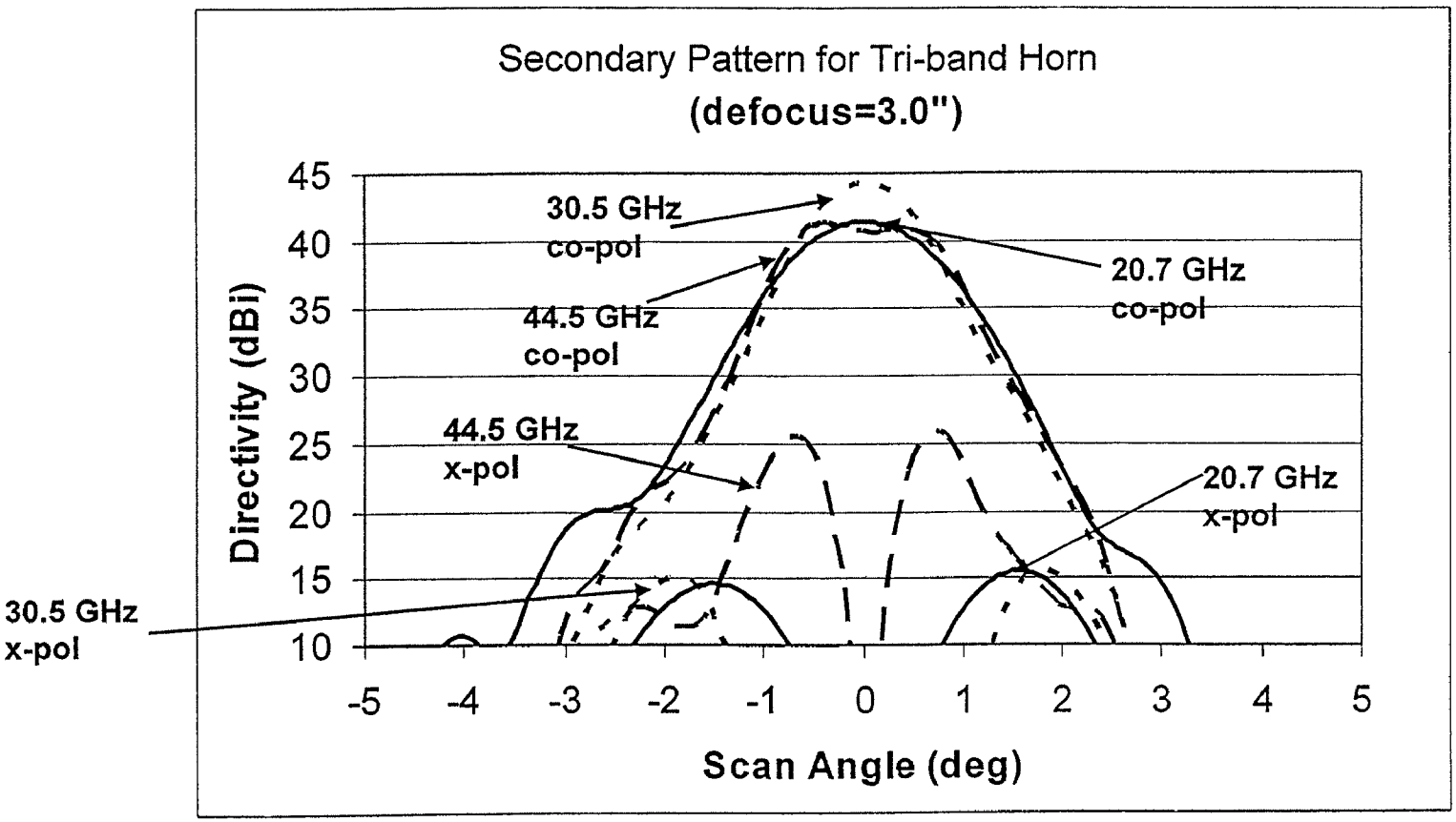
FIG. 3 is a graph of a radiation patterns of a reflector antenna using the 3.0 inch horn as a feed created by an exemplary embodiment of the invention.

FIG. 3 is a graph of a secondary radiation pattern of a reflector antenna using the exemplary embodiment of the present invention described in relation to FIG. 1 with feed horn defocused by 3.0 inches. FIG. 3 shows levels of co- and cross-polarization for the center frequencies of 20.7 GHz, 30.5 GHz, and 44.5 GHz. Notably the cross-polarization is generally much less than the co-polarization.

Figure 4:
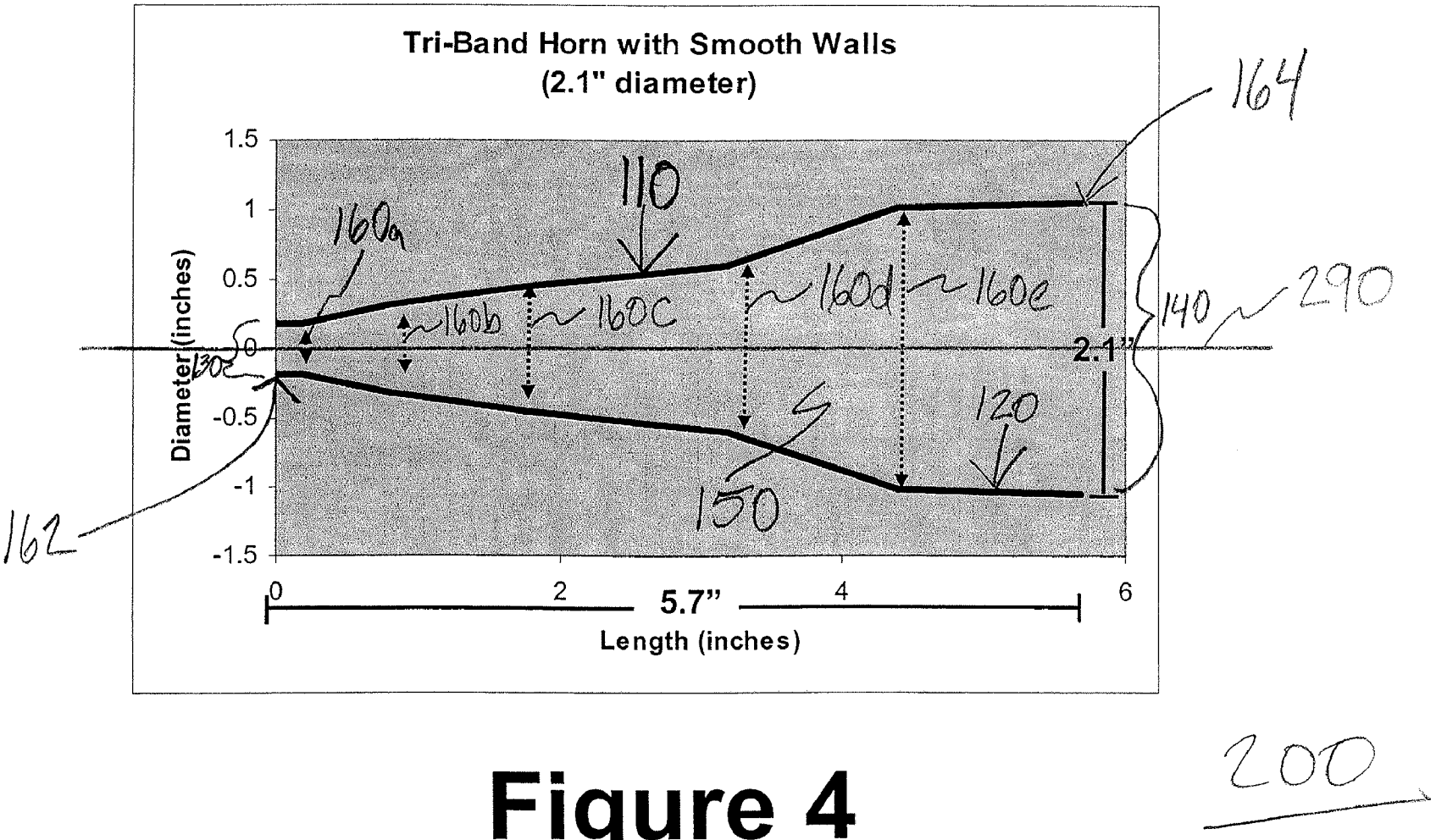
FIG. 4 is a side, cut-away view of a 2.1 inch diameter horn antenna in another exemplary embodiment of the invention.

FIG. 4 is the synthesized geometry of a 2.1 inch diameter horn of yet another exemplary embodiment of the present invention. Like components in reference to FIG. 1 are labeled with identical element numbers for ease of understanding. FIG. 4 illustrates a side, cut-away view of horn antenna 200. The horn is circularly symmetric and the figure shows the variation of the horn diameter as a function of its axial length. Horn antenna 200 comprises an exterior surface 110, an interior surface 120, a throat 130, and an aperture 140. The interior surface 120 may be an electrically conductive metal or metallic material, such as electroformed copper and/or aluminum, that allows for reception and/or transmission of radio frequency signals. Exterior surface 130 may also be metal or metallic for space applications, and may be employ other material that provides structure for interior surface 120, such as ceramic, fiberglass or plastic.

A hollow area 150 is substantially funnel-shaped, and is formed within horn antenna 200. Hollow area 150 extends from throat 130 to aperture 140 in a gradually tapered fashion along multiple slope discontinuities 160*a*, 160*b*, 160*c*, 160*d*, and 160*e*. In various exemplary embodiments each of the slope discontinuities 160*a*, 160*b*, 160*c*, 160*d*, and 160*e* may be located at varying distances from one another. In various exemplary embodiments there may be any number of slope discontinuities, to include more than three. In the exemplary embodiment shown in FIG. 4, slope discontinuity 160*a* is substantially 0.2 inches from a beginning point 162 of throat 130. Throat 130 extends from beginning point 162 to slope discontinuity 160*a* with a diameter of substantially 0.4 inches. Throat 130 may be connected to a feed network that could include OMTs (ortho-mode transducers), filters, waveguide bends, couplers, polarizers, transitions etc., (not illustrated) near or at beginning point 162 of the circular waveguide, as one skilled in the art would understand.

Slope discontinuity 160*b* is substantially 0.968 inches from beginning point 162. Hollow area 150 is substantially 0.660 inches in diameter at slope discontinuity 160*b*. Slope discontinuity 160*c* is substantially 1.973 inches from beginning point 162. Hollow area 150 is substantially 0.874 inches in diameter at slope discontinuity 160*c*. Slope discontinuity 160*d* is substantially 3.391 inches from beginning point 162. Hollow area 150 is substantially 1.221 inches in diameter at slope discontinuity 160*d*. Slope discontinuity 160*e* is substantially 4.574 inches from beginning point 162. Hollow area 150 is substantially 2.028 inches in diameter at slope discontinuity 160*e*. The largest diameter of hollow area 150 is at end point 164 located substantially 5.694 inches from beginning point 162. At end point 164 the diameter of hollow area 150 is substantially 2.1 inches in diameter, and may be covered by a protective covering (not illustrated) known to not interfere with radio frequency transmission and reception. A protective covering might be utilized to keep debris and unwanted material from entering hollow area 150.

One of skill in the art would understand that hollow area 150 may be left as is for space applications, but need not be completely hollow. For example, the hollow area may be partially or completely filled with material known to not impede radio frequency transmission and reception, such as foam or glass, for certain applications, for example, certain ground applications.

While hollow area 150 is referred to herein as possessing a "diameter," those skilled in the art would understand that horn antenna 200 may be used for either circular or linear polarization.

The exemplary embodiment of the present invention described in relation to FIG. 4 produced the RF performance shown in the table given below.

| Frequency (GHz) | Return Loss (dB) | Edge Taper (dB) | X-pol (20°) (dB) | Efficiency (%) | Efficiency (dB) |
|---|---|---|---|---|---|
| 20.2 | −25.5 | 17.1 | −20.7 | 79 | −1.0 |
| 21.2 | −28.8 | 17.7 | −21.6 | 79 | −1.0 |
| 30.0 | −45.0 | 15.8 | −22.2 | 61 | −2.1 |
| 31.0 | −42.2 | 16.8 | −23.1 | 61 | −2.1 |
| 43.5 | −41.1 | 25.0 | −23.7 | 53 | −2.8 |
| 45.5 | −40.8 | 23.6 | −22.8 | 51 | −2.9 |

In reference to both of FIGS. 1 and 4, both figures, illustrate a longitudinal section of different-sized horn antennas. In certain exemplary embodiments of the present invention, if one were to place an axis coaxial to the center diameter of the horn antennas 100/200 from the throat 130 to the aperture 140, such as axis 290 shown in FIG. 4, it is clear that none of interior surface 120 reaches a negative slope from throat 130 to aperture 140. It is also clear that the positive slopes of the interior surface 120 gradually taper from slope discontinuity to slope discontinuity. That is, the positive slope of the interior surface 120 does not reach a ninety-degree angle from an axis coaxial to the center of the diameter of the horn antenna 200, such as axis 290 shown in FIG. 4. Further, the slope of the interior surface 120 lacks a zero degree angle with reference to axis 290 with the exception of the throat 130 from beginning point 162 to slope discontinuity 160*a*. Because throat 130 possesses the same diameter for about 0.2 inches between beginning point 162 and slope discontinuity 160*a*, throat 130 has substantially a zero degree slope relative to the axis 290. This section is considered as part of the waveguide, and not the horn that flares gradually to a larger diameter.

The positive slopes of interior surface 120 taper gradually without any abrupt changes. For example, in certain exemplary embodiments of the present invention, the slope discontinuities do not include a sharp change such as a ninety-degree angle. In one aspect of certain exemplary embodiments, the slope discontinuities shown in FIGS. 1 and 4 therefore do not represent what those of skill in the art refer to as "corrugations." In another aspect of certain exemplary embodiments, the regions between the slope discontinuities are not curved.

Figure 5:
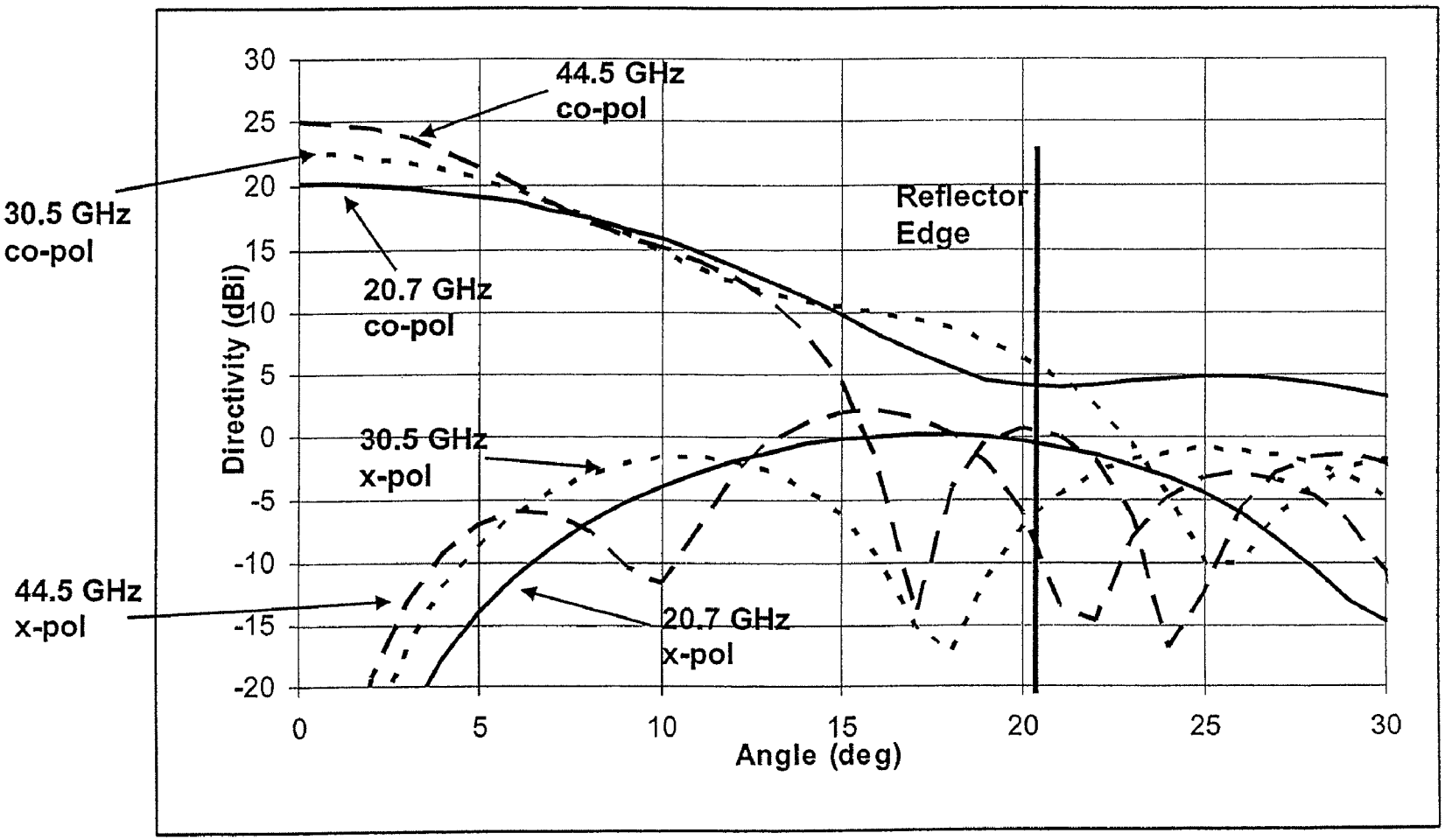
FIG. 5 is a graph of a radiation pattern amplitudes of the 2.1 inch diameter horn at three frequency bands of the exemplary embodiment of the invention.

FIG. 5 is the plot of computed radiation pattern amplitudes of the exemplary embodiment of the present invention described in relation to FIG. 4. The figure shows levels of co- and cross-polarization for the center frequencies of the three frequency bands, i.e., 20.7 GHz, 30.5 GHz, and 44.5 GHz. Notably the cross-polarization amplitudes are much lower than the co-polarization levels.

Figure 6:
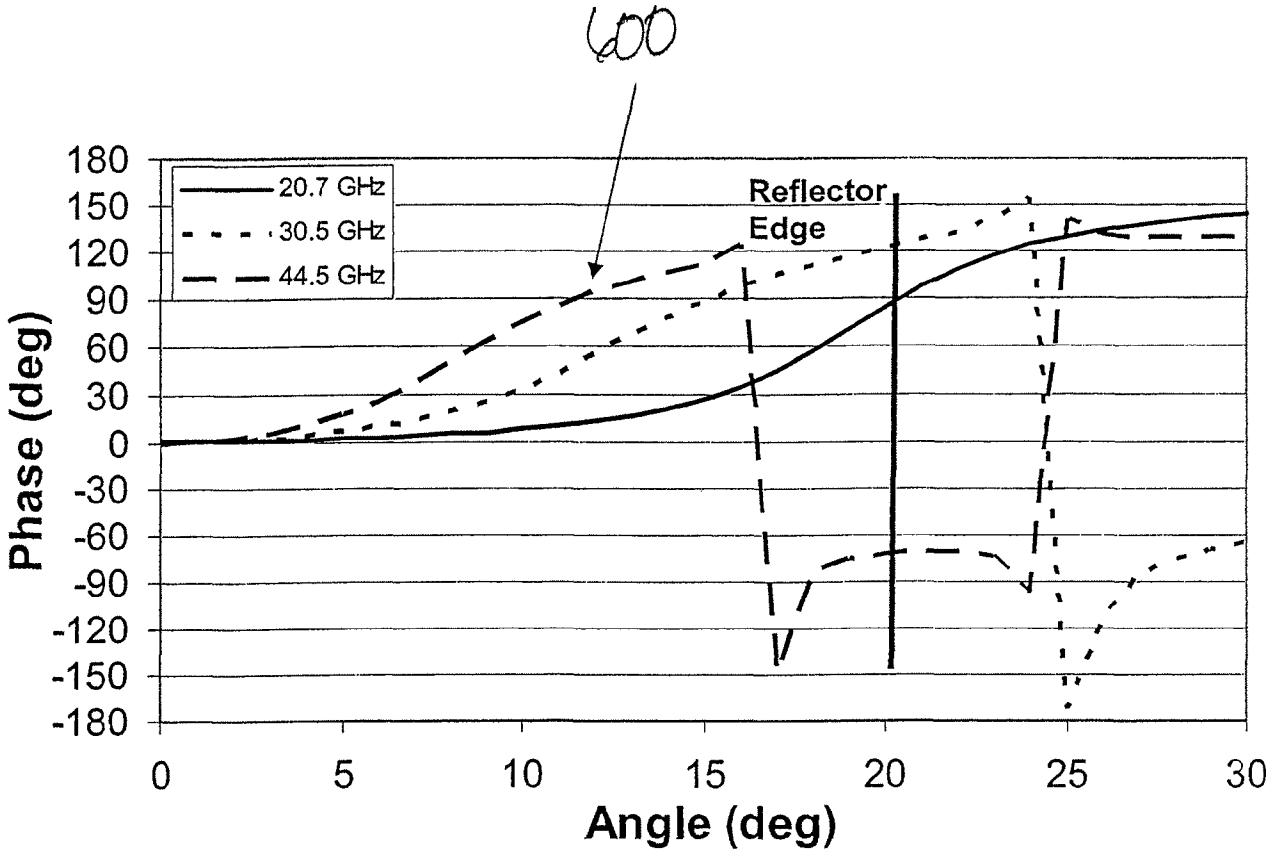
FIG. 6 is a graph of a radiation pattern phase of the 2.1 inch diameter horn at three frequency bands of the exemplary embodiment of the invention with 0.0 inch defocus.

FIG. 6 is a graph of a primary radiation phase patterns taken with a defocus of zero inches in accordance with the exemplary embodiment of the present invention described in relation to FIG. 4. The figure shows three frequency bands, including 20.7 GHz, 30.5 GHz, and 44.5 GHz. Element 600 is a point where phase slope is due to the phase center not being in the aperture plane (such as a plane created by element 140 shown in FIGS. 1 and 4).

Figure 7:
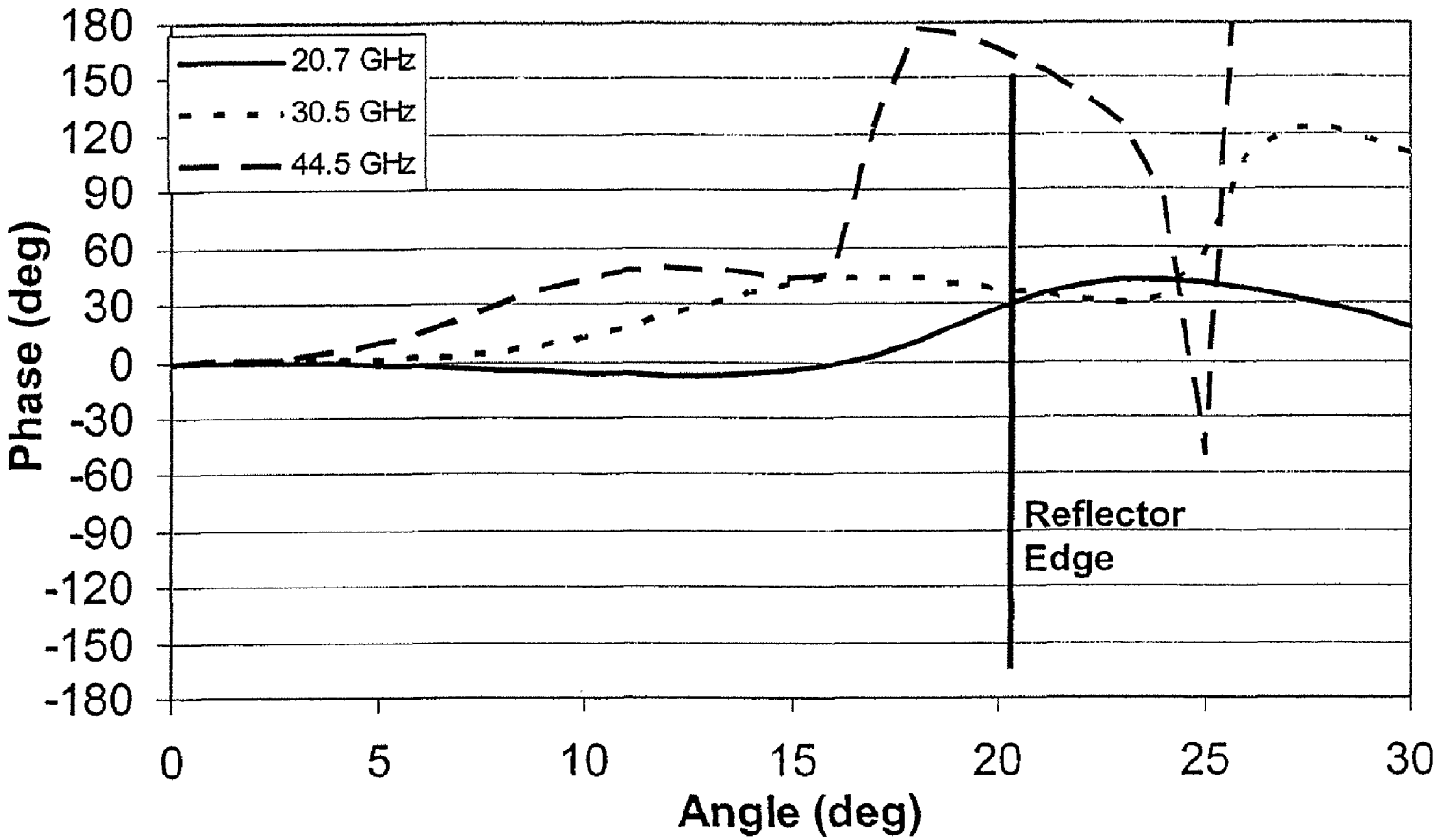
FIG. 7 is a graph of a radiation pattern phase of the 2.1 inch diameter horn at three frequency bands of the exemplary embodiment of the invention created by an exemplary embodiment of the invention with 1.5 inch defocus.

FIG. 7 is a graph of a primary radiation phase patterns taken with a defocus of 1.5 inches in accordance with the exemplary embodiment of the present invention described in relation to FIG. 4. The figure shows center frequencies of the three frequency bands, including 20.7 GHz, 30.5 GHz, and 44.5 GHz. Note that the quadratic phase-slope is reduced relative to that shown in FIG. 6 due to aperture plane (element 140 shown in FIG. 4) being moved by 1.5 inches relative to the focal-point (element 1420 shown in FIG. 14) and towards the reflector (element 1410 shown in FIG. 14).

Figure 8:
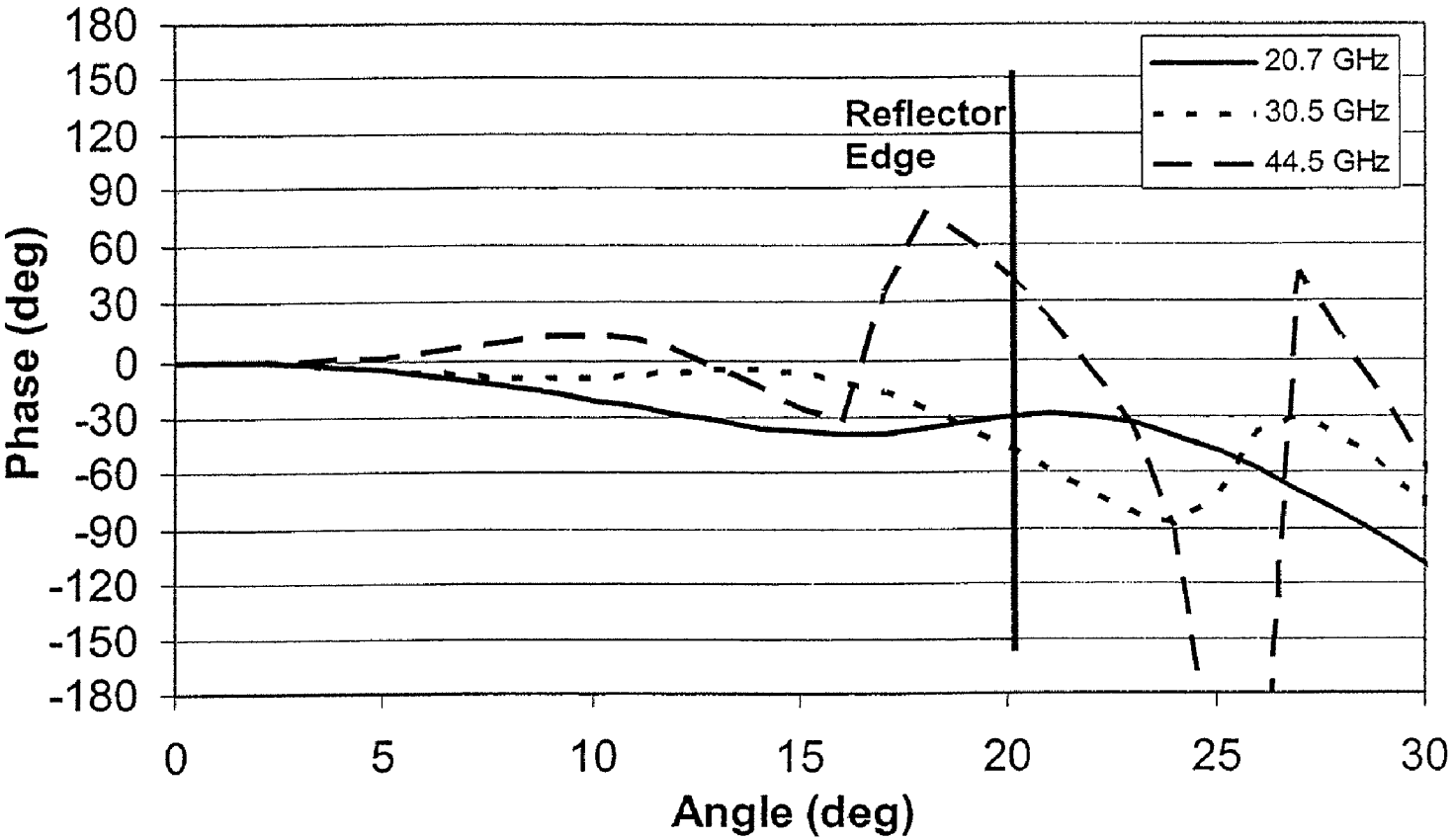
FIG. 8 is a graph of a radiation pattern phase of the 2.1 inch diameter horn at three frequency bands of the exemplary embodiment of the invention created by an exemplary embodiment of the invention with 3.0 inch defocus.

FIG. 8 is a graph of a primary radiation pattern taken with a defocus of 3 inches in accordance with the exemplary embodiment of the present invention described in relation to FIG. 4. The figure shows center frequencies of the three frequency bands, including 20.7 GHz, 30.5 GHz, and 44.5 GHz. Note that the quadratic phase-slope is reduced relative to that shown in FIG. 6 due to aperture plane (element 140 shown in FIG. 4) being moved by 3.0 inches relative to the focal-point (element 1420 shown in FIG. 14) and towards the reflector (element 1410 in FIG. 14).

Figure 9:
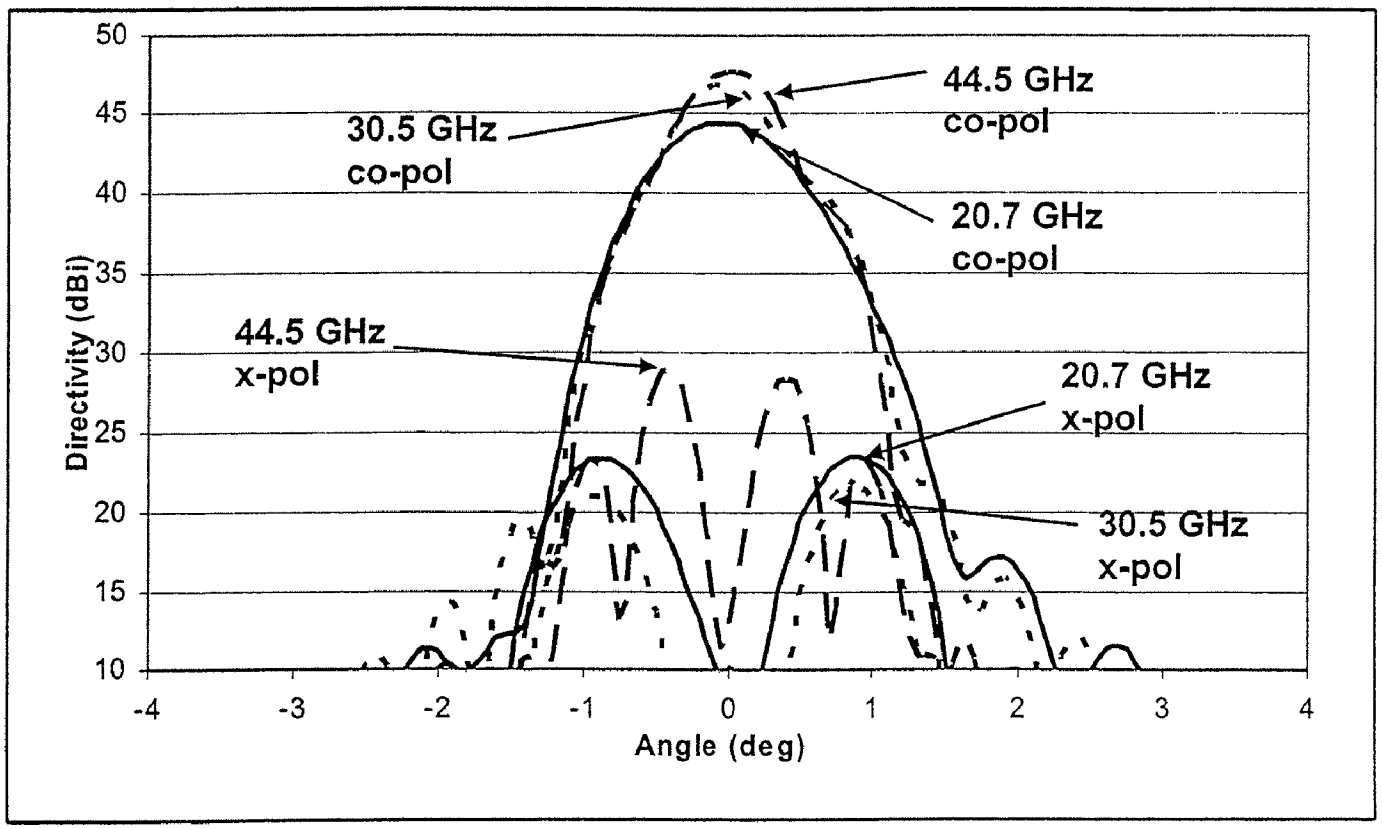
FIG. 9 is a graph of a radiation patterns of the reflector antenna using the exemplary feed patterns of FIGS. 5 & 6.

FIG. 9 is a graph of a secondary radiation patterns of the reflector antenna with the exemplary embodiment of the present invention described in FIG. 4, where the patterns are computed with a defocus of zero inches. The figure shows levels of co- and cross-polarization amplitudes at center frequencies of the three frequency bands, i.e., 20.7 GHz, 30.5 GHz, and 44.5 GHz. Notably the cross-polarization amplitude is much lower than the co-polarization amplitude. The table below shows computed performance evaluated over the beam coverages indicating minimum values of antenna gains over the coverage beam for co-polarization, cross-polarization, and the corresponding C/X (copular to cross-polar gain ratio) values at frequencies of 20.7 GHz, 30.5 GHz, and 44.5 GHz taken from an exemplary embodiment of the present invention, and specifically that embodiment described in relation to FIG. 4 as a secondary radiation pattern with a defocus of zero inches.

| freq | Coverage | co-pol | c/x |
|---|---|---|---|
| 20.7 | ±0.5° | 40.8 | 19.6 |
| 30.5 | ±0.5° | 41.2 | 23.9 |
| 44.5 | ±0.25° | 45.9 | 20.2 |

Figure 10:
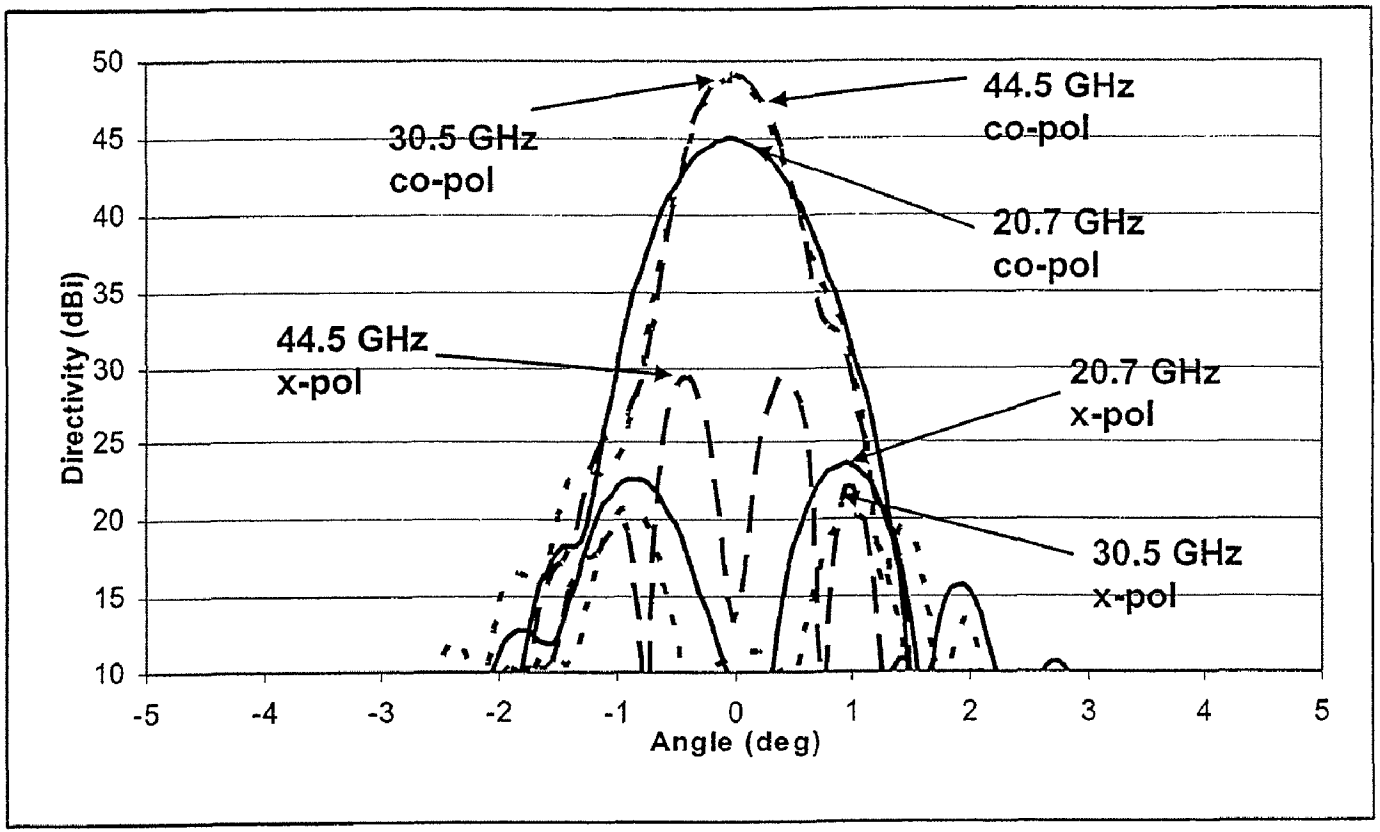
FIG. 10 is a graph of a radiation patterns of the reflector antenna using the exemplary feed patterns shown in FIGS. 5 & 7.

FIG. 10 is a graph of a secondary radiation patterns of the reflector antenna with the exemplary embodiment of the present invention described in FIG. 4, where the patterns are computed with a defocus of 1.5 inches. The figure shows levels of co- and cross-polarization amplitudes at center frequencies of the three frequency bands, i.e., 20.7 GHz, 30.5 GHz, and 44.5 GHz. Notably the cross-polarization amplitude is much lower than the co-polarization amplitude. The table below shows computed performance evaluated over the beam coverage indicating minimum values of antenna gains over the coverage beam for co-polarization, cross-polarization, and the corresponding C/X (copular to cross-polar gain ratio) values at frequencies of 20.7 GHz, 30.5 GHz, and 44.5 GHz taken from an exemplary embodiment of the present invention, and specifically that embodiment described in relation to FIG. 4 as a secondary radiation pattern with a defocus of 1.5 inches.

| freq | Coverage | co-pol | c/x |
|---|---|---|---|
| 20.7 | ±0.5° | 41.3 | 19.6 |
| 30.5 | ±0.5° | 40.6 | 26.2 |
| 44.5 | ±0.25° | 47.0 | 20.7 |

Figure 11:
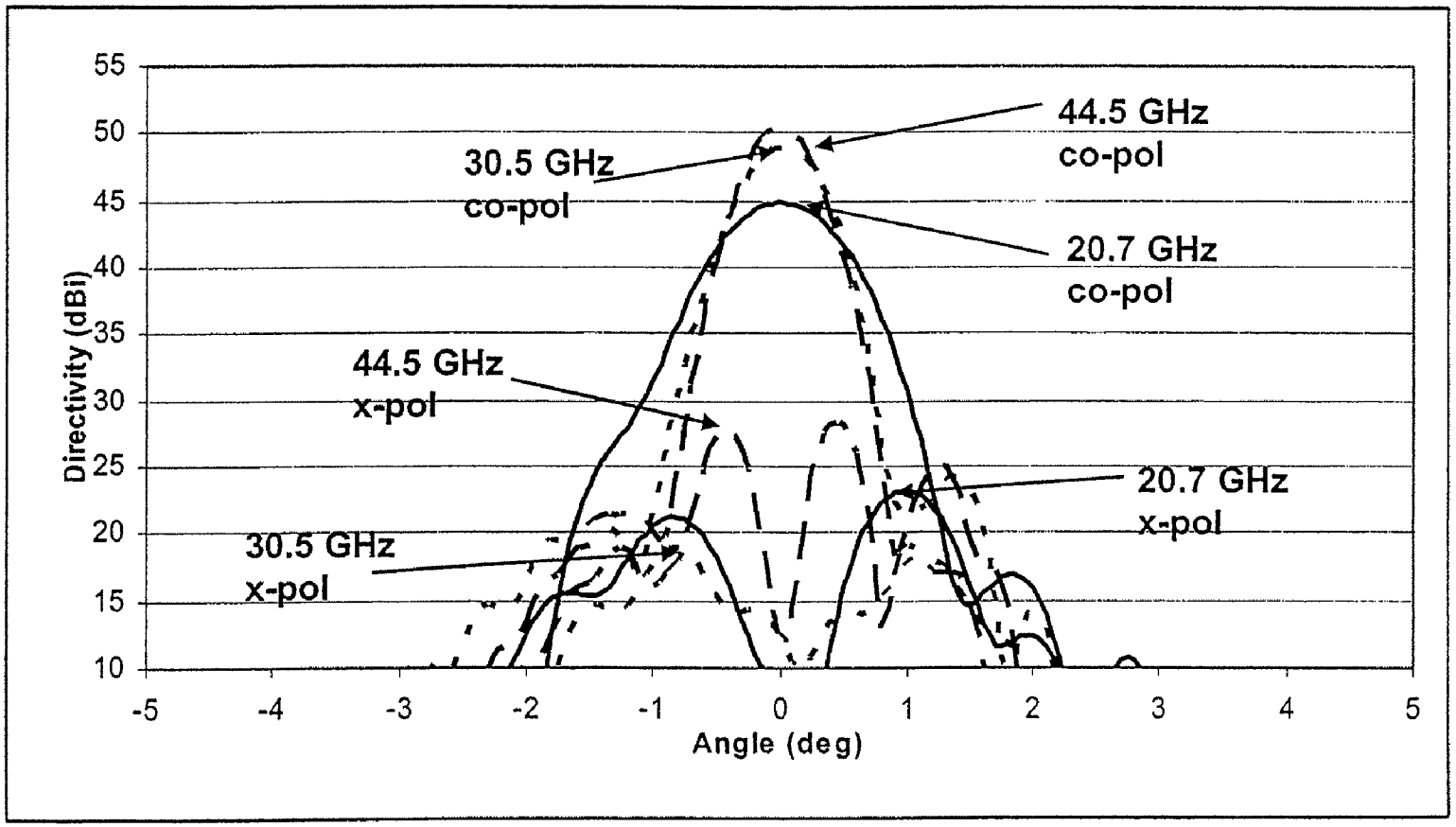
FIG. 11 is a graph of a radiation patterns of the reflector antenna using the exemplary feed patterns shown in FIGS. 5 & 8.

FIG. 11 is a graph of a secondary radiation patterns of the reflector antenna with the exemplary embodiment of the present invention described in FIG. 4, where the patterns are computed with a defocus of 3.0 inches. The figure shows levels of co- and cross-polarization amplitudes at center frequencies of the three frequency bands, i.e., 20.7 GHz, 30.5 GHz, and 44.5 GHz. Notably the cross-polarization amplitude is much lower than the co-polarization amplitude. The table below shows computed performance evaluated over the beam coverages indicating minimum values of antenna gains over the coverage beam for co-polarization, cross-polarization, and the corresponding C/X (copular to cross-polar gain ratio) values at frequencies of 20.7 GHz, 30.5 GHz, and 44.5 GHz taken from an exemplary embodiment of the present invention, and specifically that embodiment described in relation to FIG. 4 as a secondary radiation pattern with a defocus of 3.0 inches.

| freq | Coverage | co-pol | c/x |
|---|---|---|---|
| 20.7 | ±0.5° | 41.2 | 20.1 |
| 30.5 | ±0.5° | 40.8 | 22.3 |
| 44.5 | ±0.25° | 47.6 | 22.0 |

Figure 12:
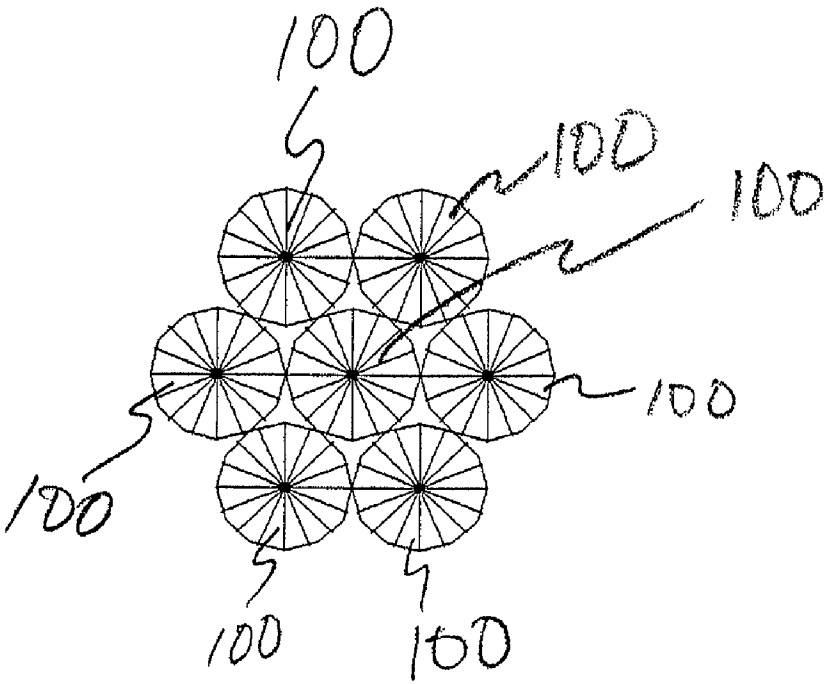
FIG. 12 is an illustration of a horn antenna array in an exemplary embodiment of the invention to create multiple beams.

FIG. 12 illustrates an aspect of an exemplary embodiment of the present invention showing multiple horn antennas 100 arranged in an array 1200, wherein the feed array illuminates the reflector antenna in order to create multiple beams. One skilled in the art would understand that multiple horn antennas 100 could be arranged to create different sets of multiple beams as needed or desired.

Figure 13:
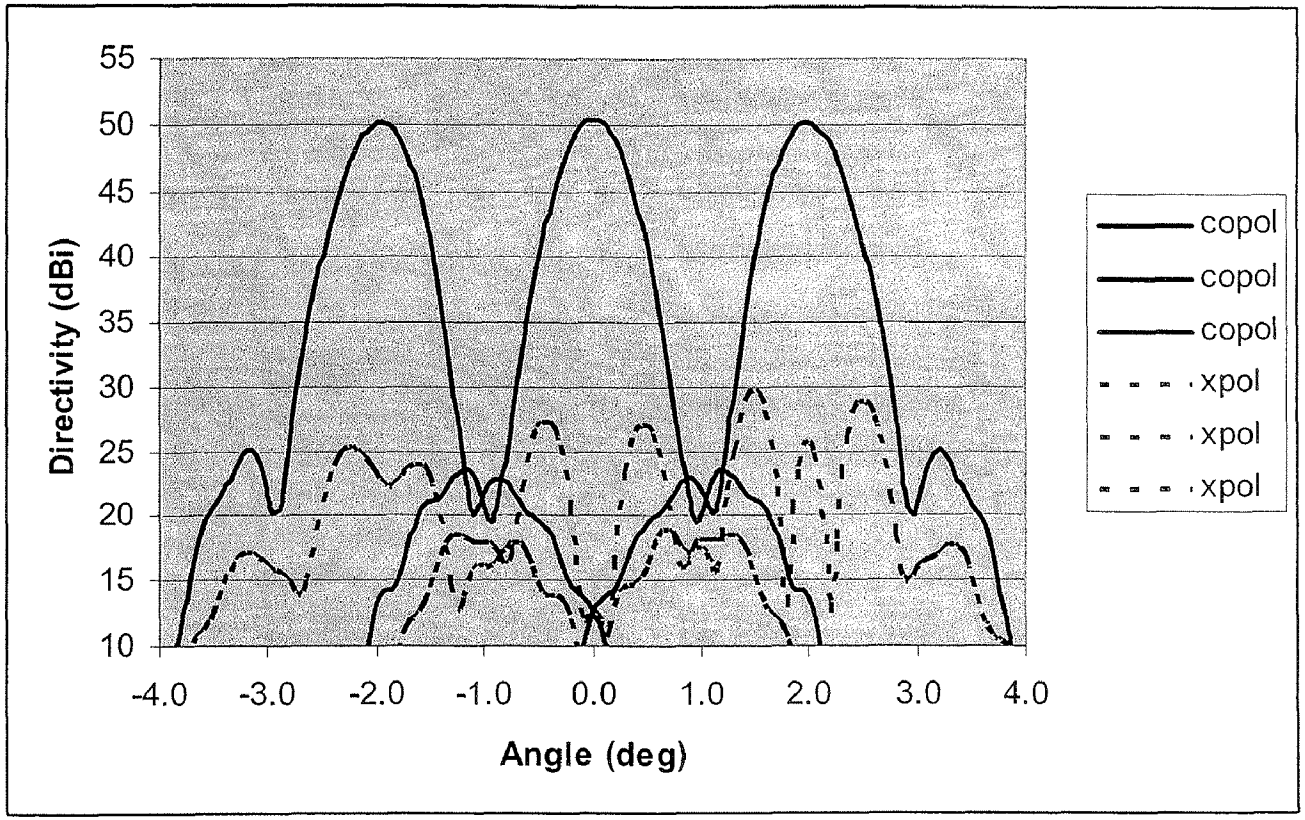
FIG. 13 is a graph of a radiation patterns of three beams created by an exemplary embodiment of the invention.

FIG. 13 is a graph of a radiation pattern taken with an antenna array comprising multiple horn antennas, such as the antenna array 1200 and horn antennas 100 shown in FIG. 12. The figure shows 3 beam patterns in the azimuth-plane (created by 3 of the 7 horns), each at 44.5 GHz.

Figure 14:
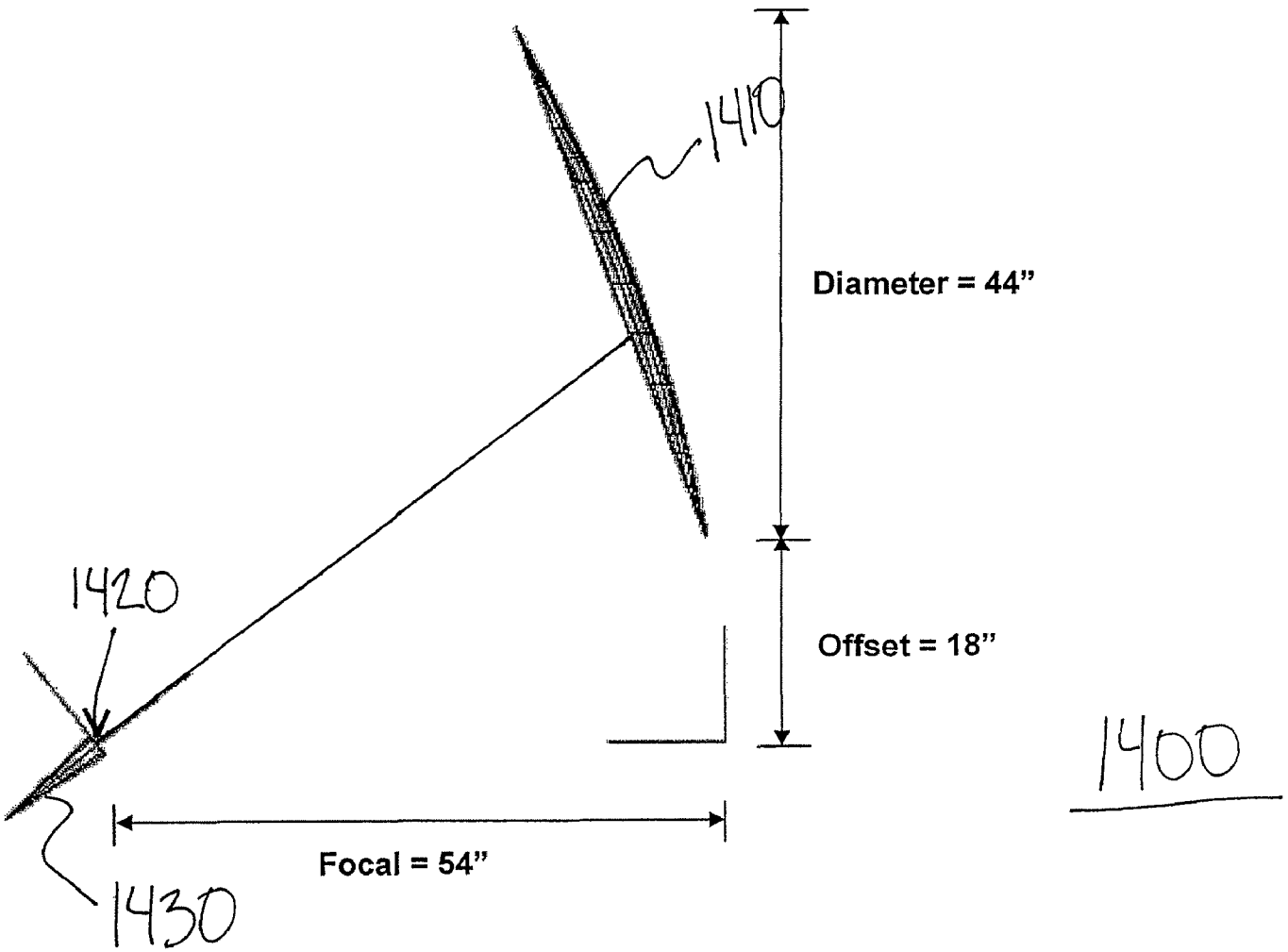
FIG. 14 is an illustration of a reflector antenna as an aspect of an exemplary embodiment of the invention.

FIG. 14 illustrates an exemplary embodiment of the present invention including a horn antenna system 1400. Horn antenna system 1400 includes reflector antenna 1410 and horn antenna 1430. Element 1420 is the focal point of the reflector antenna. The horn aperture center (for example, the center of the aperture plane shown by element 140 in FIG. 4) coincides with the focal point for a zero inch defocused case. Horn antenna 1430 is typically mounted and supported by the spacecraft deck, while the reflector could be deployed away from the spacecraft or could be mounted on the spacecraft depending on the size of the reflector and detailed accommodation of the payload. Horn antenna 1430 may be an array of horn antennas, and may be disposed perpendicular to an axis extending generally along a radio frequency focal point 1420 and the center of the reflector aperture. Horn antenna 1430 may be configured to transmit and/or receive radio frequency signals simultaneously at the three different military bands of 20.2 to 21.2 GHz, 30 to 31 GHz, and 43.5 to 45.5 GHz by reflecting radio frequency signals off of reflector antenna 1410.

Additional aspects of exemplary embodiments of the present invention include the following. In certain exemplary embodiments, the present invention is a compact tri-band feed horn antenna with smooth walls configured to transmit and/or receive in multiple frequencies simultaneously, for instance, to simultaneously transmit at 20.7 GHz and receive at both of 30.5 GHz and 44.5 GHZ for space applications, and/or to simultaneously receive at 20.7 GHz and transmit at both 30.5 GHz and 44.5 GHz for ground applications. The slope discontinuities may be analyzed and optimized using mode-matching programs and/or algorithms. In the exemplary embodiment of the invention discussed above in relation to FIG. 4, five slope-discontinuities are used to create a desired transverse electric TE1,n mode(s) for improved efficiency and better cross-polarization performance. In one aspect of certain exemplary embodiments of the present invention, no transverse magnetic (TM) modes are created.

The exemplary embodiment of the invention shown in FIG. 4 as discussed above has an aperture 140 opening that is 2.1 inches in diameter. The horn antenna has a length of 5.7 inches and provides better than a 25 dB return loss, better than a 20 dB cross-polar level below beam peak and much higher efficiency than corrugated horn antennas. Exemplary embodiments of the present invention may include horn antennas configured to have more than an octave bandwidth with a 2.25:1 bandwidth ratio, and may be used in various applications, for example, horn antennas of the present invention may be included as part of a satellite configured to transmit and/or receive at 20/30/45 GHz or other frequency ranges. Exemplary embodiments of the present invention may be made in a compact manner, such as that illustrated by the exemplary embodiments referred to in FIGS. 1 and 4. Certain exemplary embodiments may be made to be light weight using electroformed copper and/or aluminum. The horn antennas of the present invention are generally much higher efficiency than present corrugated horns, as shown by the results of the above tables, and are suitable for multibeam applications. Exemplary embodiments of the present invention may utilize 5 slope-discontinuities to generate a desired transverse electric TE1,n modes for improved efficiency and better cross-polarization performance.

Exemplary embodiments of the present invention include horn antennas configured to obtain high efficiency with higher order transverse electric (TE) modes, for instance, going beyond the dominant TE11 mode to TE12, TE13, TE14, TE15 etc. modes.

In certain exemplary embodiments of the present invention, the minimum diameter of the throat 130 is that diameter necessary to support at least the first two higher modes (TE12 & TE13) at the lowest frequency of the frequency band meant to be transmitted or received, and therefore will be no less than 1.7 times the wavelength of the lowest supported frequency. In certain exemplary embodiments of the present invention, the maximum diameter of the horn aperture 140 may be configured in view of the cross-polarizations of the highest frequency of the bands. Along these lines, in order to achieve a cross-polarization level of better than −18 dB, the maximum horn aperture 140 diameter is preferably less than 12 times the wavelength of the highest frequency.

Certain exemplary embodiments of the present invention include horn antennas configured to operate at 20/30/45 GHz for TSAT (Transformational Satellite) & FAB-T (Family of Advanced and Beyond line-of-sight Terminals) systems.

It is understood that any specific order or hierarchy or steps in the processes disclosed herein are merely exemplary illustrations and approaches. Based upon design preferences, it is understood that any specific order or hierarchy of steps in the process may be re-arranged. Some of the steps may be performed simultaneously.

The previous description is provided to enable persons of ordinary skill in the art to practice the various aspects described herein. Various modifications to these aspects will be readily apparent to those skilled in the art, and the general principles defined herein may be applied to other aspects. Thus, the claims are not intended to be limited to the aspects shown herein, but are to be accorded the full scope consistent with the claim language. Headings and subheadings, if any, are used for convenience only and do not limit the invention. All structural and functional equivalents to the elements of the various aspects described throughout the disclosure that are known or later come to be known to those of ordinary skill in the art are expressly incorporated herein by reference and are intended to be encompassed by the invention. Moreover, nothing disclosed herein is intended to be dedicated to the public regardless of whether such disclosure is explicitly recited in the above description.

As used herein, a reference to an element in the singular is not intended to mean "one and only one" unless specifically stated, but rather "one or more." The term "information" may include data taken from a radio frequency signal and may take various forms, for instance, audio, video, multimedia, instructions, commands, or other information. The term "some" refers to one or more. Underlined and/or italicized headings and subheadings are used for convenience only, do not limit the invention, and are not referred to in connection with the interpretation of the description of the invention. All structural and functional equivalents to the elements of the various embodiments of the invention described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. A horn antenna for transmitting and/or receiving radio frequency signals in multiple frequency bands, the horn antenna comprising:

an exterior surface;

an interior surface, the interior surface forming a hollow area in the horn antenna, the hollow area being substantially funnel-shaped and comprising first and second ends, the hollow area decreasing in diameter from the first end to the second end, the interior surface being smooth-walled and comprising a plurality of slope discontinuities;

an aperture disposed at the first end and comprising the largest diameter of the hollow area; and a throat disposed distally from the aperture and at the second end of the hollow area, the throat comprising the smallest diameter of the hollow area, wherein the horn antenna is configured to transmit and/or receive radio frequency signals in multiple frequency bands that are spread over more than an octave bandwidth and with at least a 2.25-to-1 bandwidth ratio, and wherein the interior surface does not include a slope having a ninety-degree angle from an axis coaxial to a center diameter of the horn antenna.

2. The horn antenna of claim 1, wherein the multiple frequency bands occupy a frequency range from at least 20.2 GHz to at least 45.5 GHz.

3. The horn antenna of claim 1, wherein the minimum aperture diameter is equal to or larger than 1.7 times the wavelength of the lowest frequency of the multiple frequency bands, and is equal to or smaller than 12 times the wavelength of the highest frequency of the multiple frequency bands.

4. The horn antenna of claim 1, wherein the plurality of slope discontinuities comprises at least three slope discontinuities, and each individual one of the plurality of slope discontinuities gradually tapers.

5. The horn antenna of claim 4, wherein a distance between adjoining ones of the plurality of slope discontinuities is between 0.333 and 3.5 inches.

6. The horn antenna of claim 1, wherein a diameter of the aperture, when divided by a length measured from the throat to the aperture, is between 0.25 and 0.4.

7. The horn antenna of claim 1, wherein the horn antenna is configured to transmit a first radio frequency signal in a first frequency band, and to simultaneously receive both a second radio frequency signal in a second frequency band and a third radio frequency signal in a third frequency band for space applications.

8. The horn antenna of claim 1, wherein the horn antenna is configured to receive a first radio frequency signal in a first frequency band, and to simultaneously transmit both a second radio frequency signal in a second frequency band and a third radio frequency signal in a third frequency band for ground applications.

9. A horn antenna for transmitting and/or receiving radio frequency signals in multiple frequency bands, the horn antenna comprising:

an exterior surface;

an interior surface disposed in the horn antenna, the interior surface forming a hollow area in the horn antenna, the hollow area being substantially funnel-shaped and comprising first and second ends, the hollow area decreasing in diameter from the first end to the second end, the interior surface being smooth-walled and comprising a plurality of slope discontinuities;

an aperture disposed at the first end and comprising the largest diameter of the hollow area, the diameter of the aperture configured to be less than 12 times the wavelength of a highest frequency of the multiple frequency bands; and a throat disposed distally from the aperture and at the second end of the hollow area, and comprising the smallest diameter of the hollow area, wherein the horn antenna is configured to transmit and/or receive radio frequency signals in multiple frequency bands, and wherein the interior surface does not include a slope having a ninety-degree angle from an axis coaxial to a center diameter of the horn antenna.

10. The horn antenna of claim 9, wherein the multiple frequency bands occupy a frequency range from at least 20.2 GHz to at least 45.5 GHz.

11. The horn antenna of claim 9, wherein the plurality of slope discontinuities comprises at least three slope discontinuities, and each individual one of the plurality of slope discontinuities gradually tapers.

12. The horn antenna of claim 9, wherein a distance between adjoining ones of the plurality of slope discontinuities is between 0.333 and 3.5 inches.

13. The horn antenna of claim 9, wherein a diameter of the throat is configured to be no less than 2.5 times the wavelength of a lowest frequency of the multiple frequency bands.

14. The horn antenna of claim 9, wherein a diameter of the throat is configured to support at least a multiplicity of higher order transverse electric modes at the lowest frequency of the multiple frequency bands with better than a 25 dB return loss.

15. The horn antenna of claim 9, wherein the horn antenna is configured to transmit a first radio frequency signal in a first frequency band, and to simultaneously receive both a second radio frequency signal in a second frequency band and a third radio frequency signal in a third frequency band for space applications.

16. The horn antenna of claim 9, wherein the horn antenna is configured to receive a first radio frequency signal in a first frequency band, and to simultaneously transmit both a second radio frequency signal in a second frequency band and a third radio frequency signal in a third frequency band for ground applications.

17. A horn antenna system for transmitting and/or receiving radio frequencies in multiple frequency bands, the horn antenna system comprising:

a reflector antenna; and a horn antenna, the horn antenna configured to transmit and/or receive radio frequencies by reflecting the radio frequencies off the reflecting antenna, the horn antenna comprising:

an exterior surface;

an interior surface disposed in the horn antenna, the interior surface forming a hollow area in the horn antenna, the hollow area being substantially funnel-shaped and comprising first and second ends, the hollow area decreasing in diameter from the first end to the second end, the interior surface being smooth-walled and comprising a plurality of slope discontinuities;

an aperture disposed at the first end and comprising the largest diameter of the hollow area; and a throat disposed distally from the aperture at the second end of the hollow area and comprising the smallest diameter of the hollow area, wherein the horn antenna is configured to transmit and/or receive radio frequency signals in multiple frequency bands with more than an octave bandwidth and with at least a 2.25-to-1 bandwidth ratio, and wherein the interior surface does not include a slope having a ninety-degree angle from an axis coaxial to a center diameter of the horn antenna.

18. The horn antenna system of claim 17, wherein the multiple frequency bands occupy a frequency range from at least 20 GHz to at least 45 GHz.

19. The horn antenna system of claim 17, wherein the plurality of slope discontinuities comprises at least three slope discontinuities, and each individual one of the plurality of slope discontinuities gradually tapers.

20. The horn antenna system of claim 17, wherein a distance between adjoining ones of the plurality of slope discontinuities is between 0.333 and 3.5 inches.

21. The horn antenna system of claim 17, wherein a diameter of the aperture, when divided by a length measured from the throat to the aperture, is between 0.25 and 0.4.

22. The horn antenna system of claim 17, comprising a plurality of horn antennas configured to transmit and/or receive the radio frequencies by reflecting the radio frequencies off the reflecting antenna.

23. The horn antenna system of claim 17, wherein the horn antenna is configured to transmit a first radio frequency signal in a first frequency band, and to simultaneously receive both a second radio frequency signal in a second frequency band and a third radio frequency signal in a third frequency band.

24. The antenna system of claim 17, wherein the feed or feed array can be defocused relative to the focal-plane of the reflector antenna in order to optimize the RF performance over multiple frequency bands.

* * * * *

UNITED STATES PATENT AND TRADEMARK OFFICE

CERTIFICATE OF CORRECTION

PATENT NO. : 8,164,533 B1
APPLICATION NO. : 12/137416
DATED : April 24, 2012
INVENTOR(S) : Chih-chien Hsu et al.

It is certified that error appears in the above-identified patent and that said Letters Patent is hereby corrected as shown below:

ON THE COVER PAGE:

(73) Assignee: Replace "Lockhead Martin Corporation" with -- Lockheed Martin Corporation --

Signed and Sealed this
Third Day of July, 2012

David J. Kappos

David J. Kappos
*Director of the United States Patent and Trademark Office*